US005858946A

United States Patent [19]

Foley et al.

[11] Patent Number: 5,858,946

[45] **Date of Patent: *Jan. 12, 1999**

[54] DETERGENT COMPOSITIONS

[75] Inventors: Peter Robert Foley, South Gosforth; Lynda Anne Jones, Gosforth, both of Great Britain

[73] Assignee: Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 704,549

[22] PCT Filed: Mar. 9, 1995

[86] PCT No.: PCT/US95/03116

§ 371 Date: Feb. 4, 1997

§ 102(e) Date: Feb. 4, 1997

[87] PCT Pub. No.: WO95/25784

PCT Pub. Date: Sep. 28, 1995

[30] Foreign Application Priority Data

Mar. 19, 1994 [GB] United Kingdom ..... 9405477

[51] Int. Cl.[6] ..... C11D 3/386; C11D 3/39; C11D 1/12; C11D 3/395

[52] U.S. Cl. ..... 510/226; 510/229; 510/230; 510/392; 510/320; 510/321; 510/305; 510/316; 510/396; 510/330

[58] Field of Search ..... 510/226, 229, 510/230, 392, 514, 521, 530, 305, 306, 320, 321

[56] References Cited

U.S. PATENT DOCUMENTS

| | | | |
|---|---|---|---|
| 3,635,797 | 1/1972 | Battistoni et al. | 195/56 |
| 3,838,007 | 9/1974 | van Velzen | 195/31 |
| 4,242,219 | 12/1980 | Bogerman et al. | 252/174.12 |
| 5,318,728 | 6/1994 | Surutzidis et al. | 252/548 |

FOREIGN PATENT DOCUMENTS

| | | | |
|---|---|---|---|
| 61-51099 | 3/1986 | Japan | C11D 03/38 |

*Primary Examiner*—Kery Fries
*Attorney, Agent, or Firm*—Kim W. Zerby; Brian M. Bolam; Richard S. Echler, Sr.

[57] ABSTRACT

There is provided a detergent composition comprising conventional detergent components characterized in that it contains a lactase enzyme. The lactase enzyme is preferably incorporated into the compositions at a level of from 0,0001% to 2% active enzyme by weight of the composition.

13 Claims, No Drawings

DETERGENT COMPOSITIONS

This invention relates to detergent compositions, including dishwashing and laundry compositions, containing a lactase enzyme.

The overall performance of a detergent product, for use in washing or cleaning method, such as a laundry or dishwashing method, is judged by a number of factors, including the ability to remove soils, and the ability to prevent the redeposition of the soils, or the breakdown products of the soils on the articles in the wash.

Food soils are often difficult to remove effectively from a soiled substrate. 'Dried-on' and 'baked-on' soils derived from milk-containing products are particularly challenging soils to remove. Specific examples of such soils would include combined milk/breakfast cereal soils, cheese soils and soils from sauces containing milk, including for example Bechemel sauce. The substrates can be fabrics, or hard surfaces such as chinaware, glassware, hollowware or ware made from plastic material.

Beta-D-galactosides, including for example lactose are found in milk-containing products. Lactase enzymes are commonly used in the milk products processing industry to catalyze the breakdown of the beta-D-galactosidic substances found in such products.

Specific benefits for the use of lactase enzymes in detergent formulations, particularly those designed for use in laundry, dishwashing and household cleaning operations have not however, been previously recognized.

The Applicants have now found that lactase enzymes may valuably be incorporated into detergent compositions. The inclusion of such enzymes provides stain/soil removal benefits. Removal of milk product soils, and in particular the removal of dried-on milk product soils is especially enabled.

The Applicants have also found that the inclusion of dispersants, particularly organic polymeric dispersants, is of great value in the detergent compositions. The disperants aid dispersion of the breakdown products of the enzymatic soil degradation, thus preventing their redeposition on articles in the wash.

It is an object of the present invention to provide detergent compositions containing a lactase enzyme, which provide soil/stain removal benefits, when used cleaning and washing operations.

It is a particular object of the present invention to provide laundry and dishwashing detergent compositions containing a lactase enzyme, which provide enhanced milk product soil/stain removal.

SUMMARY OF THE INVENTION

According to the present invention there is provided a detergent composition comprising at least one detergent component selected from a surfactant and a builder compound characterized in that said composition contains a lactase enzyme.

In a preferred aspect of the invention the detergent compositions also contain a dispersant, particularly an organic polymeric disperant compound.

Lactase enzyme

An essential component of the detergent compositions of the invention is a lactase enzyme. The lactase enzyme is preferably incorporated into the compositions in accordance with the invention at a level of from 0.0001% to 2%, preferably from 0.0005% to 0.5%, more preferably from 0.001% to 0.05% active enzyme by weight of the composition.

By lactase enzyme it is meant herein an enzyme which acts to break down beta-D-galactosidic substances, including for example lactose, which is a common constituent of milk products. Specifically the lactase enzyme acts to catalyze the hydrolysis of a beta-D-galactoside into a D-galactose and an alcohol. Lactose hydrolysis results in formation of a galactose and glucose.

Lactase enzymes herein include naturally derived lactase enzymes and any variants obtained by, for example, genetic engineering techniques. Any such variants may be specifically designed with regard to the optimization of performance efficiency in the detergent compositions of the invention. For example, variants may be designed such that the stability of the enzyme to commonly encountered components of such compositions is increased. Alternatively, the variant may be designed such that the optimal pH or temperature performance range of-the enzyme variant is tailored to suit the particular detergent application.

Lactase enzymes may be derived from fungal, bacterial and yeast sources. Common fungal sources are provided by certain strains of the *Aspergillus Niger* and *Aspergillus Oryzae* groups. Common yeast sources are provided by certain of the *Saccharomyces lactis* and *Kluyveromyces fragilis* groups.

Commercially available lactase enzymes include those sold by Novo Nordisk A/S, and those sold by International Bio-Synthetics (a division of Gist-Brocades BV).

Detergent components

The compositions of the invention contain at least one detergent component selected from a surfactant and a builder compound.

The detergent compositions of the invention may also contain additional detergent components. The precise nature of these additional components, and levels of incorporation thereof will depend on the physical form of the composition, and the nature of the cleaning operation for which it is to be used.

The compositions of the invention may for example, be formulated as manual and machine dishwashing compositions, hand and machine laundry detergent compositions including laundry additive compositions and compositions suitable for use in the pretreatment of stained fabrics, rinse aid compositions, and compositions for use in general household cleaning operations.

When formulated as compositions suitable for use in a machine washing method, eg: machine laundry and machine dishwashing methods, the compositions of the invention preferably contain both a surfactant and a builder compound and additionally one or more detergent components selected from organic polymeric compounds, bleaching agents, additional enzymes, suds suppressors, lime soap dispersants, soil suspension and anti-redeposition agents and corrosion inhibitors. Laundry compositions can also contain, as additional detergent components, softening agents.

When formulated as compositions for use in manual dishwashing methods the compositions of the invention preferably contain a surfactant and preferably other detergent components selected from organic polymeric compounds, suds enhancing agents, group II metal ions, solvents, hydrotropes and additional enzymes.

Surfactant system

The detergent compositions of the invention may contain as a principal detergent component a surfactant selected from anionic, cationic, nonionic ampholytic, amphoteric and zwitterionic surfactants and mixtures thereof.

The surfactant is typically present at a level of from 0.1% to 60% by weight. More preferred levels of incorporation are 0.5% to 35% by weight, most preferably from 0.5% to 20% by weight of machine dishwashing, laundry, and rinse aid compositions in accord with the invention, and from 5% to 60% by weight, more preferably from 15% to 45% by weight of manual dishwashing compositions in accord with the invention.

The surfactant is preferably formulated to be compatible with enzyme components present in the composition. In liquid or gel compositions the surfactant is most preferably formulated such that it promotes, or at least does not degrade, the stability of any enzyme in these compositions.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic surfactant

Essentially any anionic surfactants useful for detersive purposes can be included in the compositions. These can include salts (including, for example, sodium, potassium, ammonium, and substituted ammonium salts such as mono-, di- and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactant

Anionic sulfate surfactants suitable for use herein include the linear and branched primary alkyl sulfates, alkyl ethoxysulfates, fatty oleyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from about 0.5 to about 20 moles of ethylene oxide per molecule. More preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic sulfonate surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic carboxylate surfactant

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein.

Preferred alkyl ethoxy carboxylates for use herein include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula $$RO—(CHR_1—CHR_2—O)—R_3$$

wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Anionic secondary soap surfactant

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–15 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3\ CH(R^4)\ COOM$, wherein $R^3$ is $CH_3(CH_2)x$ and $R^4$ is $CH_3(CH_2)y$, wherein y can be 0 or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$—$R^6$—COOM, wherein $R^5$ is $C^7$—$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $$CH_3(CHR)_k—(CH_2)_m—(CHR)_n—CH(COOM)(CHR)_o—(CH2)_p—(CHR)_q—CH_3,$$

wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Alkali metal sarcosinate surfactant

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Nonionic-surfactant

Essentially any anionic surfactants useful for detersive purposes can be included in the compositions. Exemplary, non-limiting classes of useful nonionic surfactants are listed below.

Nonionic polyhydroxy fatty acid amide surfactant

Polyhydroxy fatty acid amides suitable for use herein are those having the structural formula $R^2CONR^1Z$ wherein : R1 is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic condensates of alkyl phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

Nonionic ethoxylated alcohol surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic ethoxylated/propoxylated fatty alcohol surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO condensates with propylene glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available Pluronic™ surfactants, marketed by BASF.

Nonionic EO condensation products with propylene oxide/ethylene diamine adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Nonionic alkylpolysaccharide surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3; t is from 0 to 10, preferably 0, and X is from 1.3 to 8, preferably from 1.3 to 3, most preferably from 1.3 to 2.7. The glycosyl is preferably derived from glucose.

Nonionic-fatty acid amide surfactant

Fatty acid amide surfactants suitable for use herein are those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Amphoteric surfactant

Suitable amphoteric surfactants for use herein include the amine oxide surfactants and the alkyl amphocarboxylic acids.

A suitable example of an alkyl aphodicarboxylic acid for use herein is Miranol(TM) C2M Conc. manufactured by Miranol, Inc., Dayton, N.J.

Amine Oxide surfactant

Amine oxides useful herein include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include -dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$–$C_{18}$ alkyl dimethylamine oxide, and $C_{10}$–$C_{18}$ acylamido alkyl dimethylamine oxide.

Zwitterionic surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Betaine surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10}$–$C_{16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{1214}$ acylamidopropylbetaine; $C_{814}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) -dimethyl (or diethyl) betaines. Complex betaine surfactants are also suitable for use herein.

Sultaine surfactant

The sultaines useful herein are those compounds having the formula $(R(R^1)_2N^+R^2SO_3^{31}$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Ampholytic surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched.

Cationic surfactants

Cationic surfactants can also be used in the detergent compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Builder compound

The detergent compositions of the present invention may contain as a principal detergent component a builder compound. A builder compound is a preferred component of machine dishwashing and laundry compositions in accord with the invention and is typically present at a level of from 1% to 80% by weight, preferably from 10% to 70% by weight, most preferably from 20% to 60% weight of the composition.

Compositions for use in manual dishwashing methods contain, at most, low levels of builder compounds. Preferably, a builder compound is incorporated in manual dishwashing compositions at a level of no more than 1.5% by weight of the composition.

The builder compounds may be water soluble or largely water insoluble. Water soluble builders are preferred when the compositions are dishwashing, especially machine dishwashing compositions and rinse aid compositions.

Suitable builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov.15, 1973.

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$:$Na_2$0 ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$: $Na_2O$ ratio of 2.0 is the most preferred silicate.

Silicates are preferably present in machine dishwashing detergent compositions in accord with the invention at a level of from 5% to 50% by weight of the composition, more preferably from 10% to 40% by weight.

Examples of less water soluble builders include the crystalline layered silicates and the largely water insoluble sodium aluminosilicates.

Crystalline layered sodium silicates have the general formula $$NaMSi_xO_{x+1.y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. The most preferred material is $\delta$-$Na_2Si_2O_5$, available from Hoechst AG as NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Suitable aluminosilicate zeolites have the unit cell formula $Na_z[(AlO_2)_z(SiO_2)y].XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate ion exchange materials can be naturally occurring materials, but are preferably synthetically derived. Synthetic crystalline aluminosilicate ion exchange materials are available under the designations Zeolite A, Zeolite B, Zeolite P, Zeolite X, Zeoilte MAP, Zeolite HS and mixtures thereof. Zeolite A has the formula $$Na_{12}[AlO_2)_{12}(SiO_2)_{12}].xH_2O$$

wherein x is from 20 to 30, especially 27. Zeolite X has the formula $Na_{86}[(AlO_2)_{86}(SiO_2)_{106}]$. 276 $H_2O$.

Organic polymeric compound

Organic polymeric compounds are particularly preferred components of the detergent compositions in accord with the invention. The polymeric compounds prevent the deposition of the breakdown products of enzymatic soil degradation on articles in the wash.

By organic polymeric compound it is meant essentially any polymeric organic compound commonly used as dispersants, and anti-redeposition and soil suspension agents in detergent compositions.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 100,000, especially 40,000 to 80,000.

Other suitable organic polymeric compounds include the polymers of acrylamide and acrylate having a molecular weight of from 3,000 to 100,000, and the acrylate/fumarate copolymers having a molecular weight of from 2,000 to 80,000.

The polyamino compounds are useful herein including those derived from aspartic acid such as those disclosed in EP-A-305282, EP-A-305283 and EP-A-351629.

Other organic polymeric compounds suitable for incorporation in the detergent compositions herein include cellulose derivatives such as methylcellulose, carboxymethylcellulose and hydroxyethylcellulose.

Further useful organic polymeric compounds are the polyethylene glycols, particularly those of molecular weight 1000–10000, more particularly 2000 to 8000 and most preferably about 4000.

Lime soap dispersant compound

The compositions of the invention may contain a lime soap dispersant compound, which has a lime soap dispersing power (LSDP), as defined hereinafter of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to , for example, in the following review articles; W. N. Linfield, Surfactant Science Series, Volume 7, p3; W. N. Linfield, Tenside Surf. Det., Volume 27, pages 159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

Polymeric lime soap dispersants suitable for use herein are described in the article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Suds suppressing system

The detergent compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl alcanol antifoam compounds, and paraffin antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight hydrocarbons such as paraffin, fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds suppressor discussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Suitable 2-alky-alcanols antifoam compounds for use herein have been described in DE 40 21 265. The 2-alkyl-alcanols suitable for use herein consist of a $C_6$ to $C_{16}$ alkyl chain carrying a terminal hydroxy group, and said alkyl chain is substituted in the a position by a $C_1$ to $C_{10}$ alkyl chain. Mixtures of 2-alkyl-alcanols can be used in the compositions according to the present invention.

A preferred suds suppressing system comprises (a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A preferred particulate suds suppressor system useful herein comprises a mixture of an alkylated siloxane of the type hereinabove disclosed and solid silica.

The solid silica can be a fumed silica, a precipitated silica or a silica, made by the gel formation technique. The silica particles suitable have an average particle size of from 0.1 to 50 micrometers, preferably from 1 to 20 micrometers and a surface area of at least 50 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. A preferred particulate antifoam compound for inclusion in the detergent compositions in accordance with the invention suitably contain an amount of silica such that the weight ratio of silica to silicone lies in the range from 1:100 to 3:10, preferably from 1:50 to 1:7.

Another suitable particulate suds suppressing system is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred particulate suds suppressing systems are described in copending European Application 91870007.1 in the name of the Procter and Gamble Company which systems comprise silicone antifoam compound, a carrier material, an organic coating material and glycerol at a weight ratio of glycerol : silicone antifoam compound of 1:2 to 3:1. Copending European Application 91201342.0 also discloses highly preferred particulate suds suppressing systems comprising silicone antifoam compound, a carrier material, an organic coating material and crystalline or amorphous aluminosilicate at a weight ratio of aluminosilicate: silicone antifoam compound of 1:3 to 3:1. The preferred carrier material in both of the above described highly preferred granular suds controlling agents is starch.

An exemplary particulate suds suppressing system for use herein is a particulate agglomerate component, made by an agglomeration process, comprising in combination (i) from 5% to 30%, preferably from 8% to 15% by weight of the component of silicone antifoam compound, preferably comprising in combination polydimethyl siloxane and silica;

(ii) from 50% to 90%, preferably from 60% to 80% by weight of the component, of carrier material, preferably starch;

(iii) from 5% to 30%, preferably from 10% to 20% by weight of the component of agglomerate binder compound, where herein such compound can be any compound, or mixtures thereof typically employed as binders for agglomerates, most preferably said agglomerate binder compound comprises a $C_{16}$–$C_{18}$ ethoxylated alcohol with a degree of ethoxylation of from 50 to 100; and (iv) from 2% to 15%, preferably from 3% to 10%, by weight of $C_{12}$–$C_{22}$ hydrogenated fatty acid.

Bleaching agents

The detergent compositions of the invention may include bleaching agent selected from chlorine bleaches, inorganic perhydrate salts, peroxyacid bleach precursors and organic peryoxacids.

Bleaching agents are preferred components of laundry and machine dishwashing compositions in accord with the invention. Manual dishwashing and rinse aid compositions in accord with the invention preferably contain no bleaching agents.

Chlorine bleaches include the alkali metal hypochlorites and chlorinated cyanuric acid salts. The use of chlorine bleaches in the composition of the invention is preferably minimized, and more preferably the compositions contain no chlorine bleach.

Inorganic perhydrate bleaching agents

The machine dishwashing and laundry detergent compositions in accord with the invention preferably include an inorganic perhydrate salt, normally in the form of the sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Sodium percarbonate, which is a preferred perhydrate for inclusion in detergent compositions in accordance with the invention, is an addition compound having a formula corresponding to $2Na_2CO_3.3H_2O_2$, and is available commercially as a crystalline solid. The percarbonate is most preferably incorporated into such compositions in coated form. The most preferred coating material comprises mixed salt of an alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is form 0.1 to 3, preferably n is from 0.3 to 1.0 and most preferably n is from 0.2 to 0.5.

Another suitable coating material is sodium silicate of $SiO_2$: $Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. Other suitable coating materials include the alkali and alkaline earth metal sulphates and carbonates.

Potassium peroxymonopersulfate is another inorganic perhydrate salt of usefulness in the detergent compositions.

Peroxyacid bleach precursors

The machine dishwashing and laundry detergent compositions in accord with the present invention also preferably include peroxyacid bleach precursors (bleach activators). The peroxyacid bleach precursors are normally incorporated at a level of from 1% to 20% by weight, more preferably from 1% to 10% by weight, most preferably from 1% to 7% by weight of the compositions.

Peroxyacid bleach precursors for inclusion in the machine dishwashing detergent compositions in accordance with the invention typically contain one or more N— or O— acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864798, 1147871 and 2143231 and imides such as are disclosed in GB-A-855735 & 1246338.

Particularly preferred bleach precursor compounds are the N,N,N$^1$,N$^1$ tetra acetylated compounds of formula $$(CH_3CO)_2—(CH_2)_x—(CH_3CO)_2$$

wherein x can be O or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Another preferred class of peroxyacid bleach activator compounds are the amide substituted compounds described in EP-A-0170386.

Other peroxyacid bleach precursor compounds include sodium nonanoyloxy benzene sulfonate, sodium trimethyl hexanoyloxy benzene sulfonate, sodium acetoxy benzene sulfonate and sodium benzoyloxy benzene sulfonate as disclosed in, for example, EP-A-0341947.

Organic peroxyacids

The machine dishwashing and laundry detergent compositions may also contain organic peroxyacids at a level of from 1% to 15% by weight, more preferably from 1% to 10% by weight of the composition.

Useful organic peroxyacids include the amide substituted peroxyacids described in EP-A-0170386.

Other organic peroxyacids include diperoxy dodecanedioc acid, diperoxy tetra decanedioc acid, diperoxyhexadecanedioc acid, mono- and diperazelaic acid, mono- and diperbrassylic acid, monoperoxy phthalic acid, perbenzoic acid, and their salts as disclosed in, for example, EP-A-0341 947.

Additional enzyme

Another optional ingredient useful in the detergent compositions is one or more additional enzymes.

Preferred additional enzymatic materials include the commercially available lipases, amylases, neutral and alkaline proteases, esterases, cellulases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase®, Savinase®, Primase®, Durazym®, and Esperase® by Novo Nordisk A/S (Denmark), those sold under the tradename Maxatase®, Maxacal® and Maxapem® by Gist-Brocades, those sold by Genencor International, and those sold under the tradename OpticleanR and Optimase® by Solvay Enzymes. Also proteases described in our co-pending application U.S. Ser. No. 08/136 797 can be included in the detergent composition of the invention. Protease enzyme may be incorporated into the compositions in accordance with the invention at a level of from 0.0001% to 2% active enzyme by weight of the composition.

Preferred amylases include, for example, α-amylases obtained from a special strain of *B licheniformis*, described in more detail in GB-1,269,839 (Novo). Preferred commercially available amylases include for example, those sold under the tradename Rapidase® by Gist-Brocades, and those sold under the tradename Fungamyl®, Termamyl® and BAN® by Novo Nordisk A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein.

A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Nordisk A/S, Bagsvaerd, Denmark, under the trade name Lipolase®. This lipase is also described in U.S. Pat. No. 4,810,414, Huge-Jensen et al, issued Mar. 7, 1989.

Also suitable are cutinases [EC 3.1.1.50] which can be considered as a special kind of lipase, namely lipases which do not require interfacial activation. Addition of cutinases to detergent compositions have been disclosed in e.g. WO 88/09367 (Genencor).

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof. Such stabilizing systems can also comprise reversible enzyme inhibitors, such as reversible protease inhibitors.

The compositions herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during washing is usually large; accordingly, enzyme stability in-use can be problematic.

Suitable chlorine scavenger anions are widely available, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired.

Dye transfer inhibition

The present invention relates to a process for inhibiting dye transfer from one fabric to another of solubilized and suspended dyes encountered during fabric laundering operations involving colored fabrics.

Polymeric dye transfer inhibiting agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidone polymers or combinations thereof.

a) Polyamine N-oxide polymers

Polyamine N-oxide polymers suitable for use herein contain units having the following structure formula

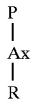

(I)

wherein P is a polymerisable unit, whereto the R—N—O group can be attached to, or wherein the R—N—O group forms part of the polymerisable unit or a combination of both.

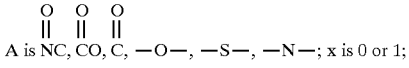

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

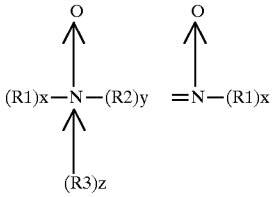

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups. The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit.

Preferred class of these polyamine N-oxides are the polyamine N-oxides having the general formula (I) wherein R is an aromatic, heterocyclic or alicyclic groups wherein the nitrogen of the N—O functional group is part of said R group. Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired watersolubility and dye-suspending power. Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

Preferred polymers for use herein may comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The preferred N-vinylimidazole N-vinylpyrrolidone copolymers have a molar ratio of N-vinylimidazole to N-vinylpyrrolidone from 1 to 0.2, more preferably from 0.8 to 0.3, most preferably from 0.6 to 0.4.

c) Polyvinylpyrrolidone

The detergent compositions herein may also utilize polyvinylpyrrolidone ("PVP" having an average molecular weight of from 2,500 to 400,000, preferably from 5,000 to 200,000, more preferably from 5,000 to 50,000, and most preferably from 5,000 to 15,000. Suitable polyvinylpyrrolidones are commercially vailable from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Cooperation include Sokalan HP 165 and Sokalan HP 12.

Polyvinylpyrrolidone may be incorporated in the detergent compositions herein at a level of from 0.01% to 5% by weight of the detergent, preferably from 0.05% to 3% by weight, and more preferably from 0.1% to 2% by weight. The amount of polyvinylpyrrolidone delivered in the wash solution is preferably from 0.5 ppm to 250 ppm, preferably from 2.5 ppm to 150 ppm, more preferably from 5 ppm to 100 ppm.

d) Polyvinyloxazolidone

The detergent compositions herein may also utilize polyvinyloxazolidones as polymeric dye transfer inhibiting agents. Said polyvinyloxazolidones have an average molecular weight of from 2,500 to 400,000, preferably from 5,000 to 200,000, more preferably from 5,000 to 50,000, and most preferably from 5,000 to 15,000.

The amount of polyvinyloxazolidone incorporated in the detergent compositions may be from 0.01% to 5% by weight, preferably from 0.05% to 3% by weight, and more preferably from 0.1% to 2% by weight. The amount of polyvinyloxazolidone delivered in the wash solution is typically from 0.5 ppm to 250 ppm, preferably from 2.5 ppm to 150 ppm, more preferably from 5 ppm to 100 ppm.

e) Polyvinylimidazole

The detergent compositions herein may also utilize polyvinylimidazole as polymeric dye transfer inhibiting agent. Said polyvinylimidazoles preferably have an average molecular weight of from 2,500 to 400,000, more preferably from 5,000 to 50,000, and most preferably from 5,000 to 15,000.

The amount of polyvinylimidazole incorporated in the detergent compositions may be from 0.01% to 5% by weight, preferably from 0.05% to 3% by weight, and more preferably from 0.1% to 2% by weight. The amount of polyvinylimidazole delivered in the wash solution is from 0.5 ppm to 250 ppm, preferably from 2.5 ppm to 150 ppm, more preferably from 5 ppm to 100 ppm.

Corrosion inhibitor

The present compositions may also contain corrosion inhibitor. Such corrosion inhibitors are preferred components of machine dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminium tristearate. The $C_{12}$–$C_{20}$ hydroxy fatty acids, or their salts, are also suitable. Phosphonated octa-decane and other anti-oxidants such as betahydroxytoluene (BHT) are also suitable.

Heavy metal ion sequestrant

The detergent compositions of the invention may be formulated to contain heavy metal ion sequestrant. Heavy metal ion sequestrant is a preferred component in laundry and machine dishwashing compositions in accord with the invention incorporated at a level of from 0.005% to 3%, preferably 0.05% to 1%, most preferably 0.07% to 0.4%

Preferred among above species are diethylene triamine penta (methylene phosphonate), hexamethylene diamine tetra (methylene phosphonate) and hydroxy-ethylene 1,1 diphosphonate.

The phosphonate compounds may be present either in their acid form or as a complex of either an alkali or alkaline metal ion, the molar ratio of said metal ion to said phosphonate compound being at least 1:1. Such complexes are described in U.S. Pat. No. 4,259,200. Preferably, the organic phosphonate compounds are in the form of their magnesium salt.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid or the water soluble alkali metal salts thereof. Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2$EDDS and $Na_3$EDDS. Examples of such preferred magnesium complexes of EDDS include MgEDDS and $Mg_2$EDDS. The magnesium complexes are the most preferred for inclusion in compositions in accordance with the invention.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

The heavy metal ion sequestrant herein can consist of a mixture of the above described species.

Softening agents

Fabric softening agents can also be incorporated into laundry detergent compositions in accordance with the present invention. These agents may be inorganic or organic in type. Inorganic softening agents are exemplified by the smectite clays disclosed in GB-A-1 400 898 and in U.S. Pat. No. 5,019,292. Organic fabric softening agents include the water insoluble tertiary amines as disclosed in GB-A-1 514 276 and EP-B-0 011 340 and their combination with mono C12–C14 quaternary ammonium salts are disclosed in EP-B-0 242 919. Other useful organic ingredients of fabric softening systems include high molecular weight polyethylene oxide materials as disclosed in EP 299,575 and EP 313,146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Calcium

From 0.01% to 3%, more preferably from 0.15% to 1% of calcium ions may be included in detergent compositions formulated for use in manual dishwashing herein. The calcium ions can, for example, be added as a chloride, hydroxide, oxide, formate or acetate, or nitrate salt.

If the anionic surfactants are in the acid form, the calcium can be added as a calcium oxide or calcium hydroxide slurry in water to neutralise the acid.

Calcium stabilizing agent

Malic, maleic or acetic acid, or their salts, or certain lime soap dispersant compounds may be added to any compositions formulated to contain calcium to provide good product stability, and in particular to prevent the precipitation of insoluble calcium salts.

Magnesium

From 0.01% to 3%, most preferably from 0.15% to 2%, by weight, of magnesium ions are preferably added to manual dishwashing compositions of the invention for improved sudsing.

Solvent

The detergent compositions of the invention may contain organic solvents. Manual dishwashing compositions in accord with the invention will preferably contain a solvent system present at levels of from 1% to 30% by weight, preferably from 3% to 25% by weight, more preferably form 5% to 20% by weight of the composition. The solvent system may be a mono, or mixed solvent system; but is preferably in mixed solvent system. Preferably, at least the major component of the solvent system is of low volatility.

Suitable organic solvent for use herein has the general formula $RO(CH_2C(Me)HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=1); and 1(2-n-butoxy-1-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE solvents are compounds of the 2-alkoxyethoxy ethanol class, with 2-butoxyethoxyethanol being preferred.

Other suitable solvents are benzyl alcohol, and diols such as 2-ethyl-1,3-hexanediol and 2,2,4-trimethyl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The C1–C4 dihydric alcohols, including propylene glycol, are also preferred.

Hydrotropes

Hydrotrope is typically added to manual dishwashing and rinse aid compositions in accord with the present invention, and is typically present at levels of from 0.5% to 20%, preferably from 1% to 15%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

Other compounds useful as hydrotropes herein include polycarboxylates. Some polycarboxylates have calcium chelating properties as well as hydrotropic properties. Particularly useful hydrotropes are alkylpolyethoxy polycarboxylate surfactants of the type as previously described herein.

Other optional ingredients

Other optional ingredients suitable for inclusion in the compositions of the invention include perfumes, colours and filler salts, with sodium sulfate being a preferred filler salt.

Form of the compositions

The detergent compositions of the invention can be formulated in any desirable form such as powders, granulates, pastes, liquids, gels and tablets. Manual dishwashing compositions in accord with the invention are preferably formulated as liquids or gels.

Liquid compositions

The detergent compositions of the present invention may be formulated as liquid detergent compositions. Such liquid detergent compositions typically comprise from 94% to 35% by weight, preferably from 90% to 40% by weight, most preferably from 80% to 50% by weight of a liquid carrier, e.g., water, preferably a mixture of water and organic solvent.

Gel compositions

The detergent compositions of the present invention may also be in the form of gels. Such compositions are typically formulated with polyalkenyl polyether having a molecular weight of from about 750,000 to about 4,000,000.

Solid compositions

The detergent compositions of the invention may also be in the form of solids, such as powders, granules and tablets.

The particle size of the components of granular compositions in accordance with the invention should preferably be such that no more that 5% of particles are greater than 1.4 mm in diameter and not more than 5% of particles are less than 0.15 mm in diameter.

The bulk density of granular detergent compositions in accordance with the present invention typically have a bulk density of at least 450 g/liter, more usually at least 600 g/liter and more preferably from 650 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight-edged implement e.g. a knife, across its upper edge. The filled cup is then weighed and the value obtained for the weight of powder doubled to provide the bulk density in g/liter. Replicate measurements are made as required.

Making processes—granular compositions

In general, granular detergent compositions in accordance with the present invention can be made via a variety of methods including dry mixing, spray drying, agglomeration and granulation.

Washing methods

The compositions of the invention may be used in essentially any washing or cleaning method, including methods with rinsing steps for which a separate rinse aid composition may be added. Preferred machine and manual machine dishwashing methods are hereinafter described.

Machine dishwashing method

A preferred machine dishwashing method comprises treating soiled articles selected from crockery, glassware, hollowware and cutlery and mixtures thereof, with an aqueous liquid having dissolved or dispensed therein an effective amount of the machine dishwashing or rinsing composition as described hereinabove. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

Manual dishwashing method

According to a manual dishwashing method aspect of this invention, soiled dishes are contacted with an effective amount, typically from about 0.5 g to about 20 g (per 25 dishes being treated), preferably from about 3 g to about 10 g, of the composition of the present invention. The actual amount of detergent composition used will be based on the judgement of user, and will depend upon factors such as the particular product formulation of the composition, the concentration of the composition, the number of soiled dishes to be cleaned and the degree of soiling of the dishes.

In one preferred manual dishwashing method aspect of the invention a concentrated solution of the detergent composition is applied to the surface of the dishes to be washed. By concentrated solution of the composition it is meant no less than a 20% by weight, preferably no less than 50% by weight product dilution, and most preferably the composition is applied in undiluted form.

In another preferred manual dishwashing method aspect of the invention large volume of a dilute solution of the detergent composition is employed. The dishes are preferably allowed to soak for a period of time, typically from 5 seconds to 30 minutes in the dilute solution.

In the detergent compositions, the abbreviated component identifications have the following meanings:

LAS: Sodium linear $C_{12}$ alkyl benzene sulphonate

TAS: Sodium tallow alkyl sulphate

XYAS: Sodium $C_{1X}$–$C_{1Y}$ alkyl sulfate

SAS: $C_{12}$–$C_{14}$ secondary (2,3) alkyl sulfate in the form of the sodium salt.

APG: Alkyl polyglycoside surfactant of formula $C_{12}$—$(glycosyl)_x$, where x is 1.5, AEC: Alkyl ethoxycarboxylate surfactant of formula $C_{12}$ ethoxy (2) carboxylate.

SS: Secondary soap surfactant of formula 2-butyl octanoic acid

25EY: A $C_{12-15}$ predominantly linear primary alcohol condensed with an average of Y moles of ethylene oxide 45EY: A $C_{14}$–$C_{15}$ predominantly linear primary alcohol condensed with an average of Y moles of ethylene oxide XYEZS: $C_{1X}$–$C_{1Y}$ sodium alkyl sulfate condensed with an average of Z moles of ethylene oxide per mole Nonionic: $C_{13}$–$cl_5$ mixed ethoxylated/propoxylated fatty alcohol with an average degree of ethoxylation of 3.8 and an average degree of propoxylation of 4.5 sold under the tradename Plurafax LF404 by BASF Gmbh CFAA: $C_{12}$–$C_{14}$ alkyl N-methyl glucamide TFAA: $C_{16}$–$C_{18}$ alkyl N-methyl glucamide.

Silicate: Amorphous Sodium Silicate ($SiO_2$:$Na_2O$ ratio=2.0)

NaSKS-6: Crystalline layered silicate of formula $\delta$-$Na_2Si_2O_5$

Carbonate: Anhydrous sodium carbonate

Phosphate: Sodium tripolyphosphate

MA/AA: Copolymer of 1:4 maleic/acrylic acid, average molecular weight about 80,000

Polyacrylate: Polyacrylate homopolymer with an average molecular weight of 8,000 sold under the tradename PA30 by BASF GmbH Zeolite A: Hydrated Sodium Aluminosilicate of formula $Na_{12}(AlO_2SiO_2)_{12}$. $27H_2O$ having a primary particle size in the range from 1 to 10 micrometers Citrate: Tri-sodium citrate dihydrate Citric: Citric Acid Perborate: Anhydrous sodium perborate monohydrate bleach, empirical formula $NaBO_2.H_2O_2$ PB4: Anhydrous sodium perborate tetrahydrate Percarbonate: Anhydrous sodium percarbonate bleach of empirical formula $2Na_2CO_3.3H_2O_2$ TAED: Tetraacetyl ethylene diamine Paraffin: Paraffin oil sold under the tradename Winog 70 by Wintershall.

Lactase: Lactase enzyme sold by Novo Nordisk A/S

Protease: Proteolytic enzyme sold under the tradename Savinase by Novo Nordisk A/S Amylase: Amylolytic enzyme sold under the tradename Termamyl 60T by Novo Nordisk A/S Lipase: Lipolytic enzyme sold under the tradename Lipolase by Novo Nordisk A/S Peroxidase: Peroxidase enzyme Cellulase: Cellulosic enzyme sold under the tradename Carezyme by Novo Nordisk A/S.

CMC: Sodium carboxymethyl cellulose

HEDP: 1,1-hydroxyethane diphosphonic acid

DETPMP: Diethylene triamine penta (methylene phosphonic acid), marketed by Monsanto under the Trade name Dequest 2060

PVP: Polyvinyl pyrollidone polymer

EDDS: Ethylenediamine-N,N'-disuccinic acid, [S,S] isomer in the form of the sodium salt.

Suds Suppressor: 25% paraffin wax Mpt 50° C., 17% hydrophobic silica, 58% paraffin oil.

Granular Suds: 12% Silicone/silica, 18% stearyl

Suppressor alcohol,70% starch in granular form
ScS: Sodium cumene sulphonate
Sulphate: Anhydrous sodium sulphate.

In the following examples all levels of enzyme quoted are expressed as % active enzyme by weight of the composition.

EXAMPLE 1

The following machine dishwashing detergent compositions were prepared (parts by weight) in accord with the invention.

| | A | B | C | D | E | F |
|---|---|---|---|---|---|---|
| Citrate | 24.0 | — | — | 24.0 | 24.0 | 29.0 |
| Phosphate | — | 30.0 | 46.0 | — | — | — |
| MA/AA | 6.0 | — | — | 6.0 | 6.0 | — |
| Silicate | 27.5 | — | 33.0 | 27.5 | 27.5 | 25.7 |
| Carbonate | 12.5 | 23.5 | — | 12.5 | 12.5 | — |
| Perborate | 10.4 | 10.4 | 10.4 | 10.4 | 10.4 | 1.9 |
| PB4 | — | — | — | — | — | 8.7 |
| TAED | 3.0 | 3.0 | 3.0 | 3.0 | 3.0 | 4.4 |
| Benzotriazole | — | 0.3 | — | — | — | 0.3 |
| Paraffin | — | 0.5 | — | — | — | 0.5 |
| HEDP | — | — | — | — | — | 0.5 |
| Protease | 0.04 | 0.04 | 0.04 | 0.04 | 0.04 | 0.04 |
| Amylase | 0.02 | 0.01 | 0.01 | 0.02 | 0.01 | 0.01 |
| Lipase | 0.03 | — | 0.03 | 0.03 | 0.03 | — |
| Lactase | 0.05 | 0.07 | 0.04 | 0.01 | 0.08 | 0.05 |
| Nonionic | — | 1.5 | 1.5 | 1.5 | 1.5 | 1.5 |
| Sulphate | 1.4 | 2.4 | 2.4 | 12.1 | 12.1 | 3.0 |
| 35AE3S | — | — | 5.0 | — | 5.0 | — |
| Granular Suds Suppressor | 1.0 | — | — | — | — | — |
| Water & minors | | | Up to 100% | | | |

The compositions provide good soil removal when used in a machine dishwashing process.

EXAMPLE 2

The following liquid manual dishwashing compositions in accord with the invention were prepared.

| | % by weight | | | | |
|---|---|---|---|---|---|
| | I | II | III | IV | V |
| 23AE0.8S | 10.0 | 10.0 | 6.0 | 5.0 | 10.0 |
| 23AE3S | 7.0 | 7.0 | 10.0 | 15.0 | 7.0 |
| C12/14 alkyl amine oxide | 2.0 | 1.0 | — | 1.0 | 2.0 |
| C12/14 alkyl di methyl betaine | — | 1.0 | 1.5 | 2.0 | — |
| C12/14 Ampholak(TM) | — | — | 1.5 | — | — |
| CFAA | 12.0 | 6.0 | 12.0 | 11.0 | 12.0 |
| C10 Alkyl Ethoxylate (ave. 8) | 2.0 | 5.0 | 5.0 | 4.6 | 5.0 |
| $Mg^{++}$ ion | — | 0.6 | — | 0.3 | 0.6 |
| $Ca^{++}$ion | — | — | 0.3 | 0.15 | 0.1 |
| Maleic acid | — | — | 0.2 | 0.3 | — |
| Lactase | 0.05 | 0.01 | 0.02 | 0.03 | 0.04 |
| Protease | 0.01 | 0.02 | 0.01 | 0.02 | 0.03 |
| Water & minors | | | Up to 100% | | |

The compositions were prepared by mixing all of the surfactants with the exception of the glucamide. The magnesium and calcium salts were then pre-dissolved into the solution together with the maleic acid and added to the surfactant mixture with the remaining components. Finally the pH was trimmed to 7.3 using hydrochloric acid and the viscosity checked.

EXAMPLE 3

The following liquid manual dishwashing compositions in accord with the invention were prepared. The pH of the compositions was adjusted to be in the range 7.0 to 7.4.

| | % by weight | | | | |
|---|---|---|---|---|---|
| | I | II | III | IV | V |
| LAS | — | — | — | — | 10.0 |
| 23AE0.8S | 10.0 | 10.0 | 6.0 | 5.0 | 5.0 |
| 23AE3S | 3.0 | 7.0 | 10.0 | 15.0 | — |
| SS | — | — | 4.0 | — | |
| C12/14 alkyl amine oxide | 2.0 | 1.0 | — | 1.0 | 2.0 |
| AEC | — | — | — | 5.0 | — |
| C12/14 alkyl di methyl betaine | — | 1.0 | 1.5 | 2.0 | — |
| C12/14 Ampholak(TM) | — | — | 1.5 | — | — |
| CFAA | 12.0 | — | 12.0 | 11.0 | — |
| APG | — | 12.0 | — | — | — |
| C10 Alkyl Ethoxylate (ave. 8) | 5.0 | 5.0 | 5.0 | 4.6 | 5.0 |
| $Mg^{++}$ ion | — | 0.6 | 0.3 | 0.3 | 0.6 |
| $Ca^{++}$ion | — | — | 0.3 | 0.15 | 0.1 |
| Maleic acid | — | — | 0.2 | 0.3 | — |
| Lactase | 0.05 | 0.1 | 0.2 | 0.03 | 0.04 |
| Protease | 0.01 | 0.02 | 0.01 | 0.02 | 0.03 |
| Water & minors | | | Up to 100% | | |

EXAMPLE 4

Granular fabric cleaning compositions in accord with the invention were prepared as follows:

| | I | II | III | IV |
|---|---|---|---|---|
| LAS | 22.0 | 22.0 | 22.0 | 22.0 |
| Phosphate | 23.0 | 23.0 | 23.0 | 23.0 |
| Carbonate | 23.0 | 23.0 | 23.0 | 23.0 |
| Silicate | 14.0 | 14.0 | 14.0 | 14.0 |
| Zeolite A | 8.2 | 8.2 | 8.2 | 8.2 |
| DETPMP | 0.4 | 0.4 | 0.4 | 0.4 |
| Sodium Sulfate | 5.5 | 5.5 | 5.5 | 5.5 |
| Protease | — | — | 0.02 | — |
| Lactase | 0.04 | 0.06 | 0.01 | 0.04 |
| Water & minors | | Up to 100% | | |

EXAMPLE 5

Granular fabric cleaning compositions in accord with the invention were prepared as follows:

| | I | II | III | IV |
|---|---|---|---|---|
| LAS | 12.0 | 12.0 | 12.0 | 12.0 |
| Zeolite A | 26.0 | 26.0 | 26.0 | 26.0 |
| SS | 4.0 | 4.0 | 4.0 | 4.0 |
| SAS | 5.0 | 5.0 | 5.0 | 5.0 |
| Citrate | 5.0 | 5.0 | 5.0 | 5.0 |
| Sodium Sulfate | 17.0 | 17.0 | 17.0 | 17.0 |
| Perborate | 16.0 | 16.0 | 16.0 | 16.0 |
| TAED | 5.0 | 5.0 | 5.0 | 5.0 |
| Lactase | 0.20 | 0.01 | 0.02 | 0.08 |
| Protease | 0.06 | 0.03 | 0.02 | 0.08 |
| Water and minors | | Balance to 100% | | |

EXAMPLE 6

Granular fabric cleaning compositions in accord with the invention which are especially useful in the laundering of coloured fabrics were prepared as follows:

| | | |
|---|---|---|
| LAS | 11.4 | 10.7 |
| TAS | 1.8 | 2.4 |
| 45AS | 3.0 | 3.1 |
| 45E7 | 4.0 | 4.0 |
| 68E11 | 1.8 | 1.8 |
| Citrate | 14.0 | 15.0 |
| Citric acid | 3.0 | 2.5 |
| Zeolite A | 32.5 | 32.1 |
| MA/AA | 5.0 | 5.0 |
| DETPMP | 1.0 | 0.2 |
| Lactase | 0.01 | 0.05 |
| Protease | 0.02 | 0.02 |
| Lipase | 0.03 | 0.04 |
| Amylase | 0.03 | 0.03 |
| Silicate | 2.0 | 2.5 |
| Sulphate | 3.5 | 5.2 |
| PVP | 0.3 | 0.5 |
| Perborate | 0.5 | 1.0 |
| Peroxidase | 0.01 | 0.01 |
| Phenol sulfonate | 0.1 | 0.2 |
| Waters/Minors | Up to 100% | Up to 100% |

EXAMPLE 7

Granular fabric cleaning compositions in accord with the invention were prepared as follows:

| | | |
|---|---|---|
| LAS | 6.5 | 8.0 |
| Sulfate | 15.0 | 18.0 |
| Zeolite A | 26.0 | 22.0 |
| Sodium nitrilotriacetate | 5.0 | 5.0 |
| PVP | 0.5 | 0.7 |
| TAED | 3.0 | 3.0 |
| Boric acid | 4.0 | — |
| Perborate | 0.5 | 1.0 |
| Phenol sulphonate | 0.1 | 0.2 |
| Protease | 0.06 | 0.02 |
| Lactase | 0.01 | 0.02 |
| Silicate | 5.0 | 5.0 |
| Carbonate | 15.0 | 15.0 |
| Peroxidase | 0.1 | 0.1 |
| Water & minors | Up to 100% | |

EXAMPLE 8

Granular fabric cleaning compositions in accord with the invention were prepared as follows:

| | |
|---|---|
| 45AS | 8.0 |
| 25E3S | 2.0 |
| 25E3 | 6.0 |
| Zeolite A | 17.0 |
| NaSKS-6 | 16.0 |
| Carbonate | 7.0 |
| MA/AA | 5.0 |
| CMC | 0.4 |
| Poly (4-vinylpyridine)-N-oxide copolymer of vinylimidazole and vinylpyrrolidone | 0.1 |
| Lactase | 0.05 |
| Protease | 0.01 |
| Lipase | 0.02 |
| Cellulase | 0.02 |
| TAED | 6.0 |
| Percarbonate | 22.0 |
| EDDS | 0.3 |

-continued

| | |
|---|---|
| Granular suds suppressor | 3.5 |
| Water & minors | Up to 100% |

EXAMPLE 9

A granular fabric cleaning compositions in accord with the invention which provide "softening through the wash" capability were prepared as follows:

| | |
|---|---|
| LAS | 7.6 |
| 68AS | 1.3 |
| 45E7 | 4.0 |
| Coco-alkyl-dimethyl hydroxyethyl ammonium chloride | 1.4 |
| Citrate | 5.0 |
| Zeolite A | 15.0 |
| MA/AA | 4.0 |
| DETPMP | 0.4 |
| Perborate | 15.0 |
| TAED | 5.0 |
| Smectite clay | 10.0 |
| Protease | 0.02 |
| Lipase | 0.02 |
| Amylase | 0.03 |
| Lactase | 0.03 |
| Cellulase | 0.02 |
| Silicate | 3.0 |
| Carbonate | 10.0 |
| Suds suppressor | 1.0 |
| CMC | 0.2 |
| Water & minors | Up to 100% |

EXAMPLE 10

Heavy duty liquid fabric cleaning compositions suitable for use in the pretreatment of stained fabrics, and for use in machine laundering methods, in accord with the invention were prepared as follows:

| | I | II | III | IV | V |
|---|---|---|---|---|---|
| 24AS | 20.0 | 20.0 | 20.0 | 20.0 | 20.0 |
| SS | 5.0 | 5.0 | 5.0 | 5.0 | 5.0 |
| Citrate | 1.0 | 1.0 | 1.0 | 1.0 | 1.0 |
| $12E_3$ | 13.0 | 13.0 | 13.0 | 13.0 | 13.0 |
| Monethanolamine | 2.5 | 2.5 | 2.5 | 2.5 | 2.5 |
| Lactase | 0.02 | 0.01 | 0.05 | 0.01 | — |
| Protease | — | — | 0.02 | 0.04 | — |
| Lipase | — | — | 0.02 | — | — |

Water/propylene glycol/ethanol (100:1:1)

EXAMPLE 11

Heavy duty liquid fabric cleaning compositions in accord with the invention were prepared as follows:

| | I | II |
|---|---|---|
| $C_{12-14}$ alkenyl succinic acid | 3.0 | 8.0 |
| Citric acid | 10.0 | 15.0 |
| 25AS | 8.0 | 8.0 |
| 25AE2S | — | 3.0 |
| 25AE7 | — | 8.0 |
| 25AE3 | 8.0 | — |
| DETPMP | 0.2 | — |
| Oleic acid | 1.8 | — |
| Ethanol | 4.0 | 4.0 |
| Propanediol | 2.0 | 2.0 |

-continued

| | I | II |
|---|---|---|
| Lactase | 0.05 | 0.01 |
| Protease | 0.02 | 0.02 |
| PVP | 1.0 | 2.0 |
| Perborate | 0.5 | 1 |
| Phenol sulphonate | 0.1 | 0.2 |
| Peroxidase | 0.04 | 0.01 |
| NaOH | up to pH 7.5 | |
| Water & minors | Up to 100% | |

EXAMPLE 12

The following liquid rinse aid compositions, in accord with the invention, were prepared (parts by weight).

| | A | B | C | D | E | F |
|---|---|---|---|---|---|---|
| Citric | 6.5 | 6.5 | 6.5 | 6.5 | 6.5 | 6.5 |
| Nonionic | 12.0 | 12.0 | 12.0 | 12.0 | 12.0 | 12.0 |
| HEDP | — | 2.5 | 2.5 | 5.0 | 5.0 | 5.0 |
| DETPMP | — | — | 3.0 | — | — | — |
| EDDS | — | — | — | 3.0 | — | — |
| Polyacrylate | — | — | — | — | 5.0 | — |
| Lactase | 0.02 | 0.06 | 0.08 | 0.04 | 0.06 | 0.02 |
| SCS | 4.8 | 4.8 | 4.8 | 4.8 | 4.8 | 4.8 |
| Ethanol | 6.0 | 6.0 | 6.0 | 6.0 | 6.0 | 6.0 |
| Ammonia | 0.7 | — | — | 0.7 | 0.7 | 0.7 |
| pH 1% solution | 3.3 | 1.8 | 1.8 | 3.3 | 3.3 | 3.3 |
| Water & minors | | | Up to 100% | | | |

What is claimed is:

1. A detergent composition comprising:

a) from 0.1% to 60% by weight, of a detersive surfactant;

b) from 1% to 80% by weight, of a builder;

c) from 0.0001% to 2% by weight, of a lactase enzyme selected from the group consisting of lactase enzymes ex *Aspergillus niger, Aspergillus Oryzae, Saccharomyces lactis, Kluyveromyces fragilis* groups, and mixtures thereof; and d) the balance carriers and adjunct ingredients, said adjunct ingredients selected from the group consisting of enzymes, enzyme stabilizers, dye transfer inhibitors, corrosion inhibitors, heavy metal ion sequestrants, softening agents, hydrotropes, filler salts, perfumes, colorants, and mixtures thereof.

2. A composition according to claim 1 comprising from 0.005% to 0.5% by weight of a lactase enzyme.

3. A composition according to claim 2 comprising from 0.001% to 0.05% by weight of a lactase enzyme.

4. A composition according to claim 1 further comprising from 0.0001% to 2% by weight of an enzyme selected from the group consisting of amylase, protease, lipase enzyme, and mixtures thereof.

5. A composition according to claim 1 comprising from 0.5% to 35% by weight of a detersive surfactant.

6. A composition according to claim 1 wherein said detersive surfactant is selected from the group consisting of linear alkyl benzene sulfonate, tallow alkyl sulphate, $C_{14}$–$C_{15}$ alkyl sulfate, $C_{12}$–$C_{15}$ ethoxy alkyl sulfate having from 3 to 50 ethoxylation units, and mixtures thereof.

7. A composition according to claim 1 wherein said detersive surfactant is selected from the group consisting of poly hydroxy fatty acid amide surfactant, an ethoxylated alcohol surfactant, a propoxylated alcohol surfactant, an ethoxylated alcohol surfactant, amine oxide surfactant, and mixtures thereof.

8. A composition according to claim 1 wherein said builder is selected from the group consisting of polycarboxylate builders, phosphate builders, water soluble silicates, zeolites, and mixtures thereof.

9. A composition according to claim 1 further comprising a bleaching agent selected from:

a) 1% to 40% by weight, of an inorganic perhydrate salt;

b) 1% to 20% by weight, of a peroxyacid bleach precursor selected from the group consisting of anhydrides, esters, imides, acylated derivatives of imidazoles, acylated derivatives of oximes, and mixtures thereof; and c) 1% to 15% by weight of an organic peroxyacid.

10. A laundry detergent composition comprising:

a) from 0.0001% to 2% by weight, of a lactase enzyme from a strain selected from the group consisting of *Aspergillus Niger, Aspergillus Oryzae, Saccharomyces lactis*, and *Kluyveromyces fragilis;* b) from 0.1% to 60% by weight, of a detersive surfactant selected from the group consisting of anionic, nonionic, cationic, ampholytic, zwitterionic surfactants, and mixtures thereof;

c) from 1% to 80% by weight, of a builder;

d) optionally from 0.01% to 15% by weight of a suds suppressing system;

e) optionally from 1% to 40% by weight of a perhydrate bleach;

f) optionally from 1% to 10% by weight of a peroxygen bleach; and g) the balance carriers and adjunct ingredients, said adjunct ingredients selected from the group consisting of enzymes, enzyme stabilizers, dye transfer inhibitors, corrosion inhibitors, heavy metal ion sequestrant, softening agents, hydrotropes, filler salts, perfumes, colorants, and mixtures thereof.

11. A composition according to claim 1 wherein said builder is a zeolite builder.

12. An automatic dishwashing detergent composition comprising:

a) from 0.0001% to 2% by weight, of a lactase enzyme from a strain selected from the group consisting of *Aspergillus Niger, Aspergillus Oryzae, Saccharomyces lactis*, and *Kluyveromyces fragilis;* b) from 0.1% to 60% by weight, of a detersive surfactant selected from the group consisting of anionic, nonionic, cationic, ampholytic, zwitterionic surfactants, and mixtures thereof;

c) from 1% to 80% by weight, of a builder;

d) optionally from 0.01% to 15% by weight of a suds suppressing system;

e) optionally from 0.0001% to 2% by weight of an enzyme, said enzyme selected from the group consisting of protease, amylase, lipase enzyme and mixtures thereof;

f) optionally from 1% to 10% by weight of a bleach; and g) the balance carriers and adjunct ingredients, said adjunct ingredients selected from the group consisting of enzyme stabilizers, dye transfer inhibitors, corrosion inhibitors, heavy metal ion sequestrant, softening agents, hydrotropes, filler salts, perfumes, colorants, and mixtures thereof.

13. A composition according to claim 12 wherein said builder is a zeolite builder.

* * * * *